US009811038B2

(12) United States Patent
Tanto

(10) Patent No.: US 9,811,038 B2
(45) Date of Patent: Nov. 7, 2017

(54) IMAGE HEATING APPARATUS HAVING A DISCRIMINATING PORTION FOR DISCRIMINATING WHETHER AN ENDLESS BELT IS BROKEN

(71) Applicant: CANON KABUSHIKI KAISHA, Tokyo (JP)

(72) Inventor: Tomoaki Tanto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/960,682

(22) Filed: Dec. 7, 2015

(65) Prior Publication Data

US 2016/0161891 A1 Jun. 9, 2016

(30) Foreign Application Priority Data

Dec. 9, 2014 (JP) ..... 2014-248814
Nov. 10, 2015 (JP) ..... 2015-220240

(51) Int. Cl.
*G03G 15/00* (2006.01)
*G03G 15/20* (2006.01)

(52) U.S. Cl.
CPC ..... *G03G 15/55* (2013.01); *G03G 15/2039* (2013.01); *G03G 15/2053* (2013.01);
(Continued)

(58) Field of Classification Search
CPC ..... G03G 15/2039; G03G 15/2053; G03G 15/2017; G03G 15/2042; G03G 15/2021;
(Continued)

(56) References Cited

U.S. PATENT DOCUMENTS 9,195,182 B2 11/2015 Tanto et al.
2006/0177232 A1* 8/2006 Ehara ..... G03G 15/2039 399/44
(Continued)

FOREIGN PATENT DOCUMENTS

JP 2007003564 A 1/2007
JP 2010054688 A 3/2010
(Continued)

OTHER PUBLICATIONS

Japanese Office Action mailed in Japanese Patent Application No. 2015-220240, dated Aug. 23, 2016.

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image heating apparatus includes an endless belt, a temperature raising portion, a first detecting portion configured to detect the temperature of the endless belt at a widthwise central portion, a controller configured to control energization to the temperature raising portion depending on an output of the first detecting portion, a second detecting portion configured to detect the temperature of the endless belt at a widthwise one end portion, an air blowing portion configured to blow air depending on an output of the second detecting portion to cool the widthwise one end portion of the endless belt, and a discriminating portion configured to discriminate whether or not the endless belt is broken on the basis of the output of the second detecting portion when the air blowing portion is operated while effecting the energization to the temperature raising portion.

11 Claims, 12 Drawing Sheets

(52) U.S. Cl.
CPC . *G03G 15/2017* (2013.01); *G03G 2215/0132* (2013.01); *G03G 2215/2035* (2013.01)

(58) Field of Classification Search
CPC ..... G03G 15/2078; G03G 2215/2035; G03G 2215/2016; G03G 21/206
USPC ..... 399/33
See application file for complete search history.

(56) References Cited

U.S. PATENT DOCUMENTS

| | | | | |
|---|---|---|---|---|
| 2007/0059001 | A1* | 3/2007 | Matsuura | G03G 15/2042 399/45 |
| 2010/0104298 | A1* | 4/2010 | Hachisuka | G03G 15/2039 399/33 |
| 2012/0155937 | A1 | 6/2012 | Hamilton et al. | |
| 2013/0039674 | A1 | 2/2013 | Takami | |
| 2013/0279926 | A1* | 10/2013 | Yoshimura | G03G 15/205 399/33 |

FOREIGN PATENT DOCUMENTS

| | | | |
|---|---|---|---|
| JP | 2011113006 | A | 6/2011 |
| JP | 2013037278 | A | 2/2013 |
| JP | 2014-10319 | A | 1/2014 |

* cited by examiner

IMAGE HEATING APPARATUS HAVING A DISCRIMINATING PORTION FOR DISCRIMINATING WHETHER AN ENDLESS BELT IS BROKEN

FIELD OF THE INVENTION AND RELATED ART

The present invention relates to an image heating apparatus for heating a toner image on a sheet. This image heating apparatus is mountable in an image forming apparatus, of an electrophotographic type, such as a copying machine, a printer, a facsimile machine or a multi-function machine of these machines.

In recent years, a fixing device (image heating apparatus) of a belt heating type has been put into practical use from the viewpoints of a quick start property and an energy saving property. Specifically, a fixing belt (endless belt) is sandwiched between a ceramic heater and a pressing roller, so that a nip is formed. Into the nip, a recording material (sheet) on which a toner image is formed is introduced and then heated and pressed, so that the toner image is fixed on the recording material.

Thus, the fixing device of the belt heating type is a thin fixing belt and is small in thermal capacity, and also has a good thermal responsivity, and therefore thermal response of the heater can be efficiently reflected in the fixing belt. Further, a temperature of the fixing belt can be caused to reach a target fixing temperature in a short time from turning-on of the heater, and on the basis of these effects, electric power saving is realized.

In such a fixing device, if in the case where a stapled recording material is introduced into a nip, there is a liability that a crack occurs at a widthwise end portion of the fixing belt. Such a crack becomes large with continuous image formation and finally causes an image defect.

In a fixing device disclosed in Japanese Laid-Open Patent Application (JP-A) 2014-10319, a method in which two thermistors for detecting a temperature of a fixing belt at a widthwise central portion and a width one end portion are provided for detecting abnormal rotation of the fixing belt has been proposed although the method does not aim at detection of the crack. Specifically, in JP-A 2014-10319, a technique for discriminating whether or not the fixing belt is rotated depending on a difference in detection temperature between the two thermistors is disclosed.

However, in the case where the method disclosed in JP-A 2014-10319 is used, the following problem cannot be solved.

FIG. 6 shows the case where a crack K occurs in the neighborhood of a widthwise end portion of a fixing belt. Here, the crack K has a length (width) W with respect to a widthwise direction of the fixing belt and has a length (width) L with respect to a circumferential direction of the fixing belt. Further, the fixing belt is 30 mm in diameter.

According to study by the present inventor, in the above method, an occurrence of the crack K could not be detected from an occurrence of a crack K of W=1 mm and L=1 mm until a size of the crack K grows to W=15 mm and L=45 mm with continuous image formation.

Such a crack may preferably be detected early, and therefore a method for that purpose has been required.

SUMMARY OF THE INVENTION

According to an aspect of the present invention, there is provided an image heating apparatus comprising: an endless belt configured to heat a toner image on a sheet; a temperature raising portion configured to raise a temperature of the endless belt; a first detecting portion configured to detect the temperature of the endless belt at a widthwise central portion of the endless belt; a controller configured to control energization to the temperature raising portion depending on an output of the first detecting portion; a second detecting portion configured to detect the temperature of the endless belt at a widthwise one end portion of the endless belt; an air blowing portion configured to blow air depending on an output of the second detecting portion to cool the widthwise one end portion of the endless belt; and a discriminating portion configured to discriminate whether or not the endless belt is broken on the basis of the output of the second detecting portion when the air blowing portion is operated while effecting the energization to the temperature raising portion.

Further features of the present invention will become apparent from the following description of exemplary embodiments with reference to the attached drawings.

DESCRIPTION OF THE EMBODIMENTS

[Embodiment 1]

(1) Image Forming Apparatus

Figure 2:
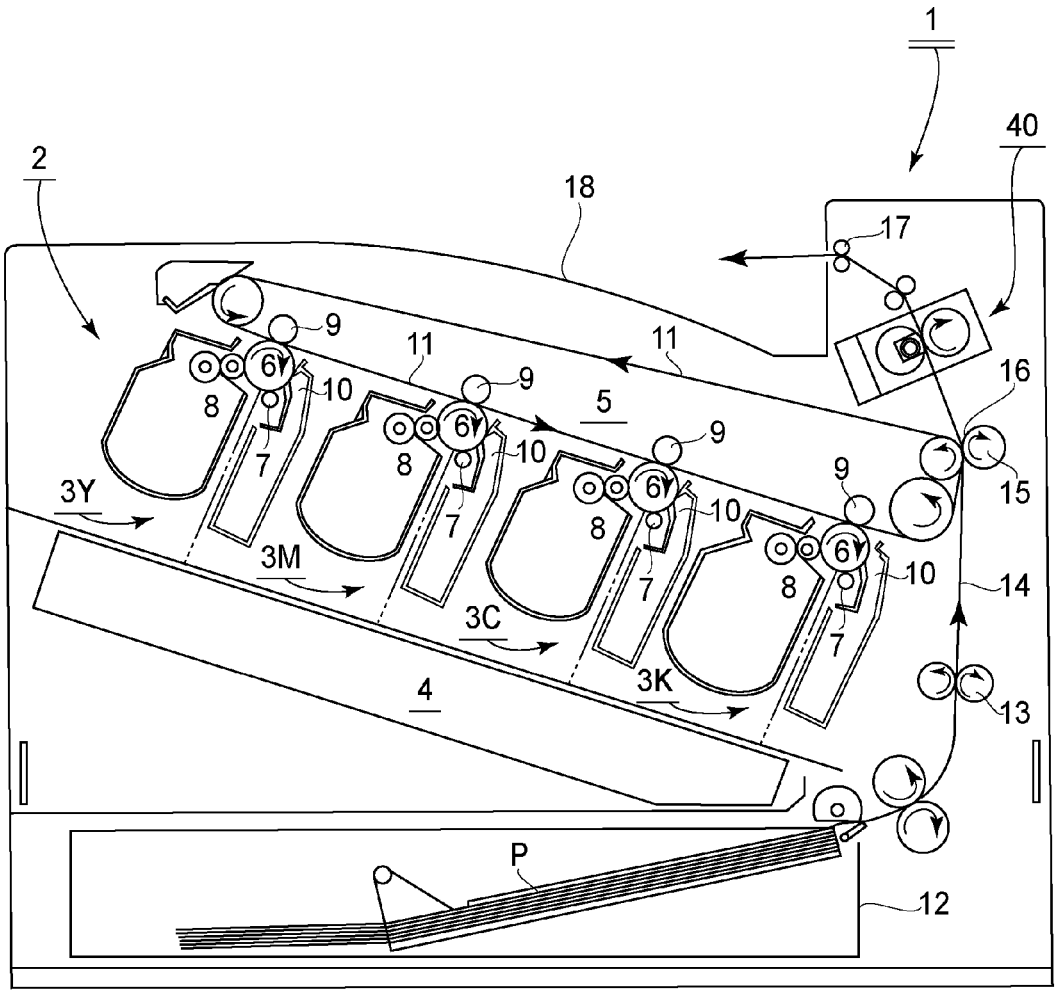
FIG. 2 is a schematic view of an example of an image forming apparatus.

FIG. 2 is a schematic view of an example of an image forming apparatus 1 in which an image heating apparatus according to the present invention is mounted as a fixing device (fixing apparatus) 40. This image forming apparatus 1 is a four-color basis full-color electrophotographic laser printer of an intermediary transfer type and a tandem type, and is capable of forming and printing out a full-color toner image on a sheet P. The sheet P is a recording material (recording medium) on which the toner image is capable of being formed, and may comprise plain paper, glossy paper, a resin-made sheet, thick paper, a postcard, an envelope, an OHP sheet, printing paper, format paper or the like. Hereinafter, these sheets or papers are referred to as the sheet P.

Printer constitutions other than the constitution of the fixing device 40 are well known, and therefore will be briefly described below.

An image forming portion 2 includes process cartridges 3 (3Y, 3M, 3C, 3K) as 4 image forming units which are juxtaposed, a laser scanner unit 4 as an exposure means, and an intermediary transfer belt unit 5. Each cartridge 3 includes a rotatable drum-type photosensitive member 6, a charging roller 7, a developing device 8, a primary transfer roller 9, a cleaning member 10, and the like which are used as electrophotographic image forming process means. Each cartridge 3 forms a toner image (developer image) of yellow (Y), magenta (M), cyan (C) or black (K) on the associated photosensitive member 6.

The above 4 color toner images are successively primary transferred from the photosensitive members of the cartridges 3 onto an intermediary transfer belt 11 in a predetermined superposition manner, so that a full-color toner image is formed on the intermediary transfer belt 11. Then, the full-color toner image is secondary-transferred onto the sheet P at a secondary transfer nip 16 which is a press-contact portion between the intermediary transfer belt 11 and a secondary transfer roller 15.

The sheet P is separated and fed one by one from a sheet cassette 12 and is introduced into the secondary transfer nip 16 at predetermined control timing along a feeding path 14 including a registration roller pair 13. Then, the sheet P subjected to secondary transfer of the toner image is introduced into the fixing device 40, so that the toner image is fixed on the sheet P under application of heat and pressure.

The sheet P coming out of the fixing device 40 is discharged as a full-color image-formed product by a discharging roller pair 17 onto a tray 18 which is an upper surface of the image forming apparatus. In the case of an operation in a monochromatic image forming mode, only the cartridge necessary to form an associated color toner image performs an image forming operation, and other cartridges are only subjected to idling of the photosensitive members 6 but do not perform the image forming operation.

In the image forming apparatus 1 in this embodiment, feeding of the sheet P in the apparatus is made by a so-called center(-line) basis feeding. This sheet feeding is made so that even any width sheet usable (passable) in the apparatus is passed in such a manner that a widthwise center line of the sheet is aligned with a widthwise center of a sheet feeding path.

(2) Fixing Device

Figure 1:
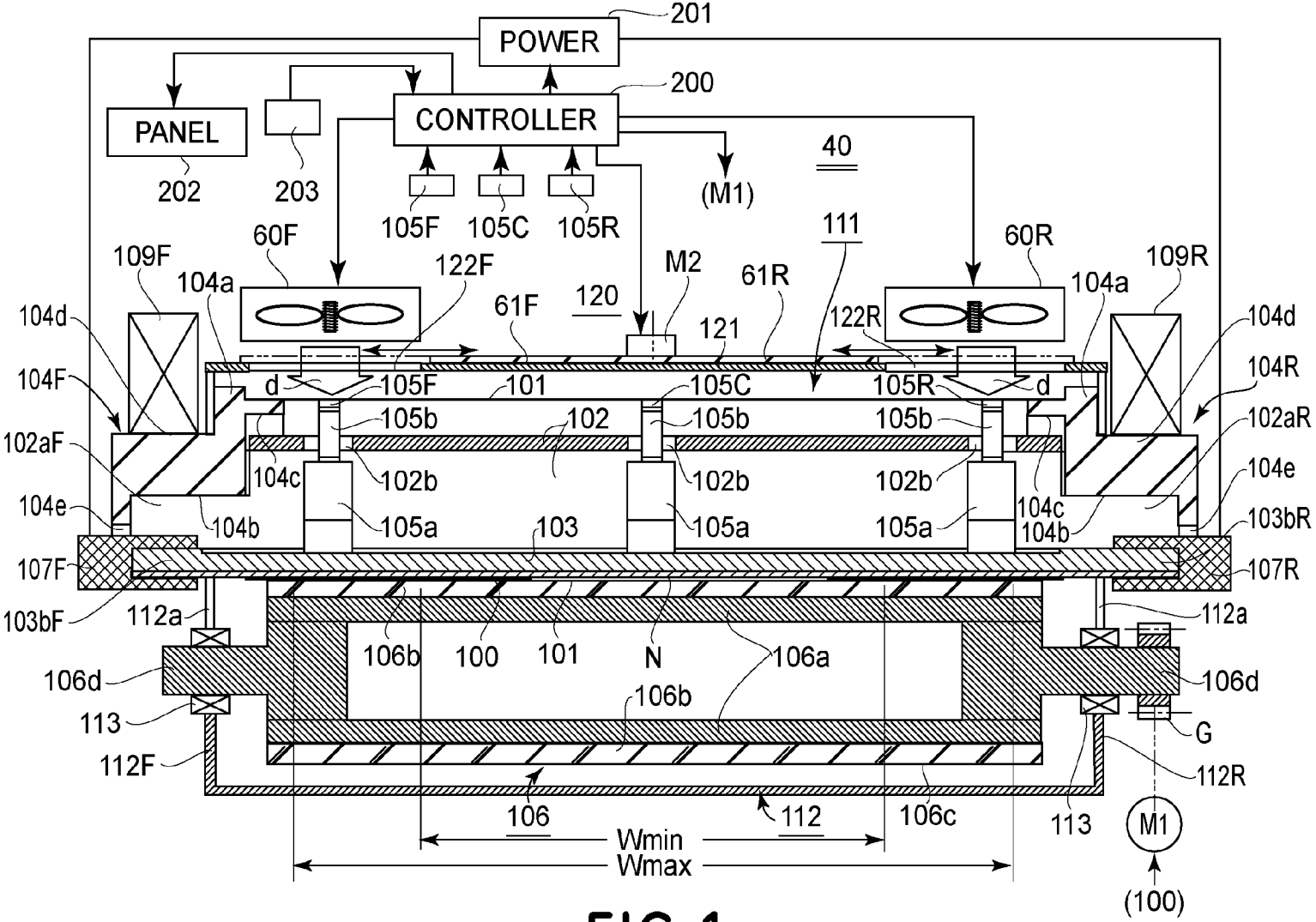
FIG. 1 is a schematic longitudinal sectional front view of a principal part of a fixing device in Embodiment 1.
Figure 3:
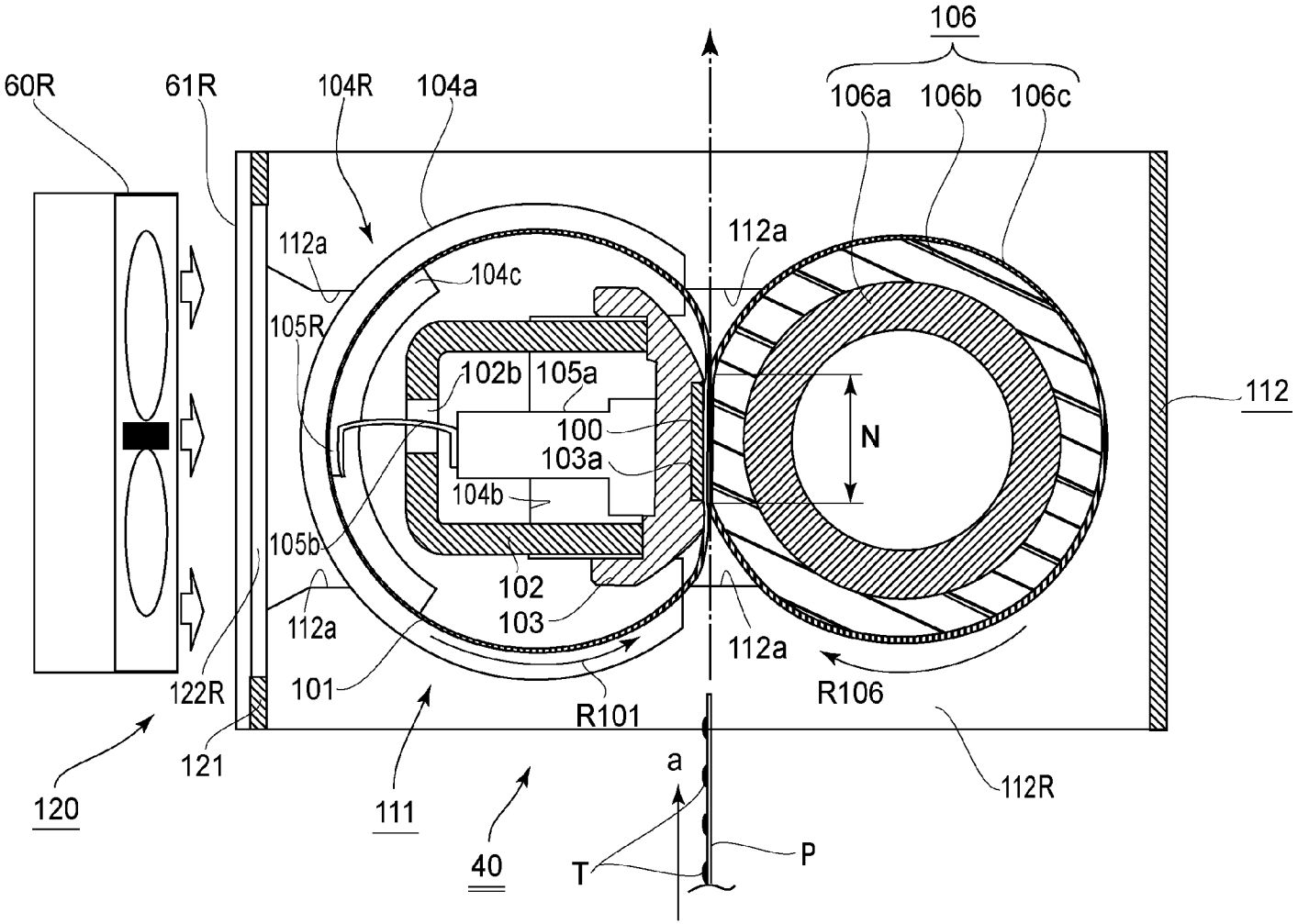
FIG. 3 is an enlarged cross-sectional right side view of the principal part of the fixing device shown in FIG. 1.

The fixing device 40 in this embodiment is an image heating apparatus of a belt (film) heating type and a pressing roller driving type (tension-less type). FIG. 1 is a schematic longitudinal sectional front view of a principal part of the fixing device 40, and FIG. 3 is an enlarged cross-sectional right side view of the principal part of the fixing device 40.

In this embodiment, with respect to the fixing device 40 or constituent members thereof, a front (surface) side is a side (surface) in which the device or member is viewed from a sheet entrance side, and a rear (surface) side is a side (surface) (sheet exit side) opposite from the front side. Left and right are left (one end side) and right (the other end side). Upper (above) and lower (below) are those with respect to the direction of gravity. A longitudinal direction (or widthwise direction) or a sheet width direction is a direction substantially parallel to a direction perpendicular to a sheet feeding direction a in a sheet feeding path plane. A short direction is a direction substantially parallel to the sheet feeding direction a in the sheet feeding path plane.

In this embodiment, the fixing device 40 is provided so that the front side which is the sheet entrance side is directed downward relative to an image forming apparatus main assembly, so that the sheet P fed upward from the secondary transfer nip 16 is guided by a sheet back surface guiding member (not shown) to be introduced into the fixing device 40 from below to above.

The fixing device 40 includes a belt unit 111 provided with a cylindrical fixing belt (heat-conductive member) 101 as a rotatable endless belt for heating the image on the sheet (recording material) at the nip. The fixing device 40 further includes a pressing roller (pressing member) 106 as a nip-forming member for forming the nip between itself and the fixing belt 101 and for nip-feeding the sheet P on which the toner image T is carried. The fixing device 40 further includes a fixing frame (casing) 112 in which the belt unit 111 and the pressing roller 106 are accommodated.

The fixing device 40 further includes, for taking countermeasures against end portion temperature rise, an abnormal cooling unit 120 as an air blowing portion for cooling the belt 101 in each of one end side and the other end side with respect to the widthwise direction (longitudinal direction) from an outside of the belt.

(2-1) Belt Unit

Figure 4:
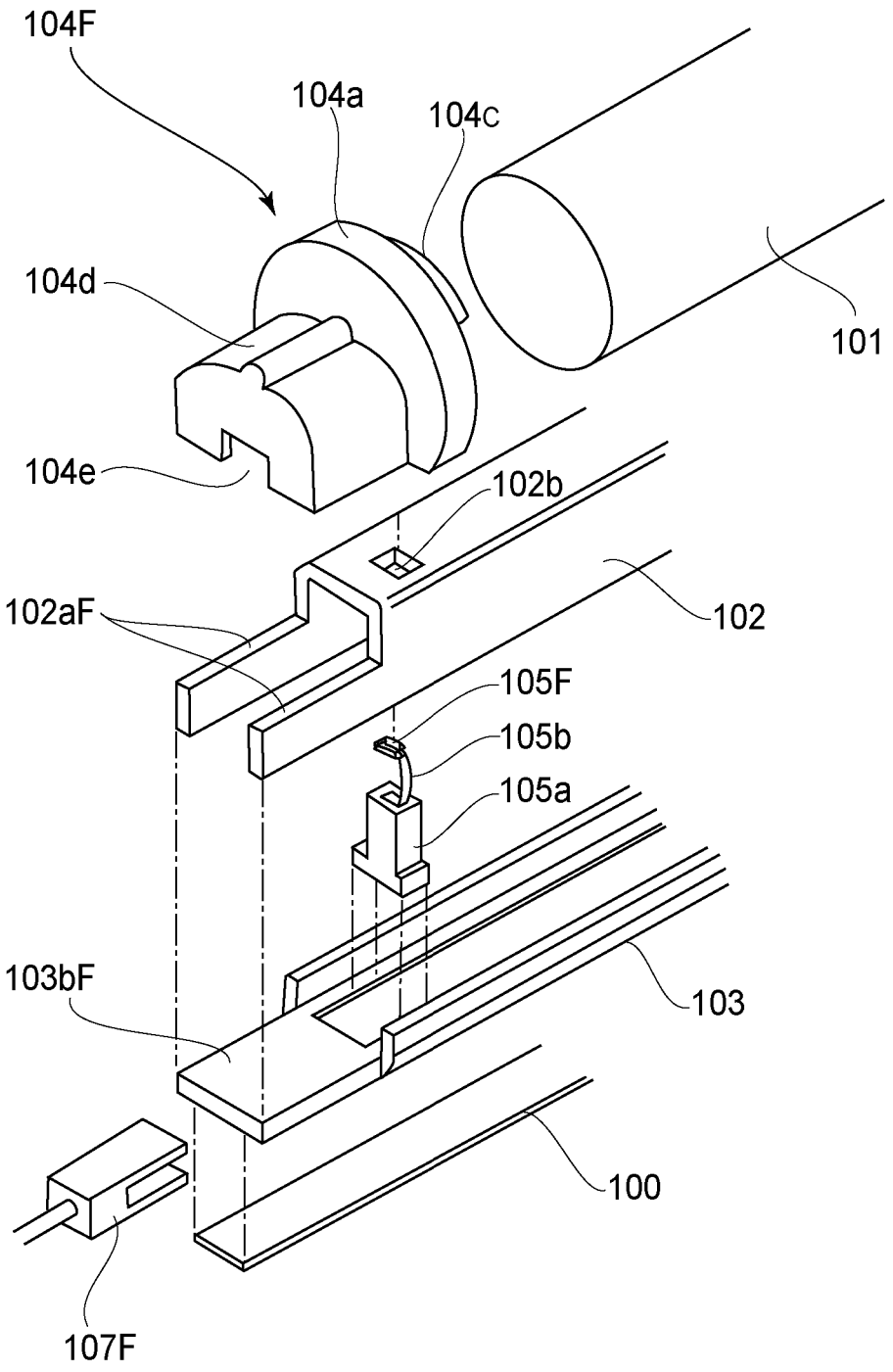
FIG. 4 is an exploded perspective view of a belt unit in a left side (one end side).
Figure 5:
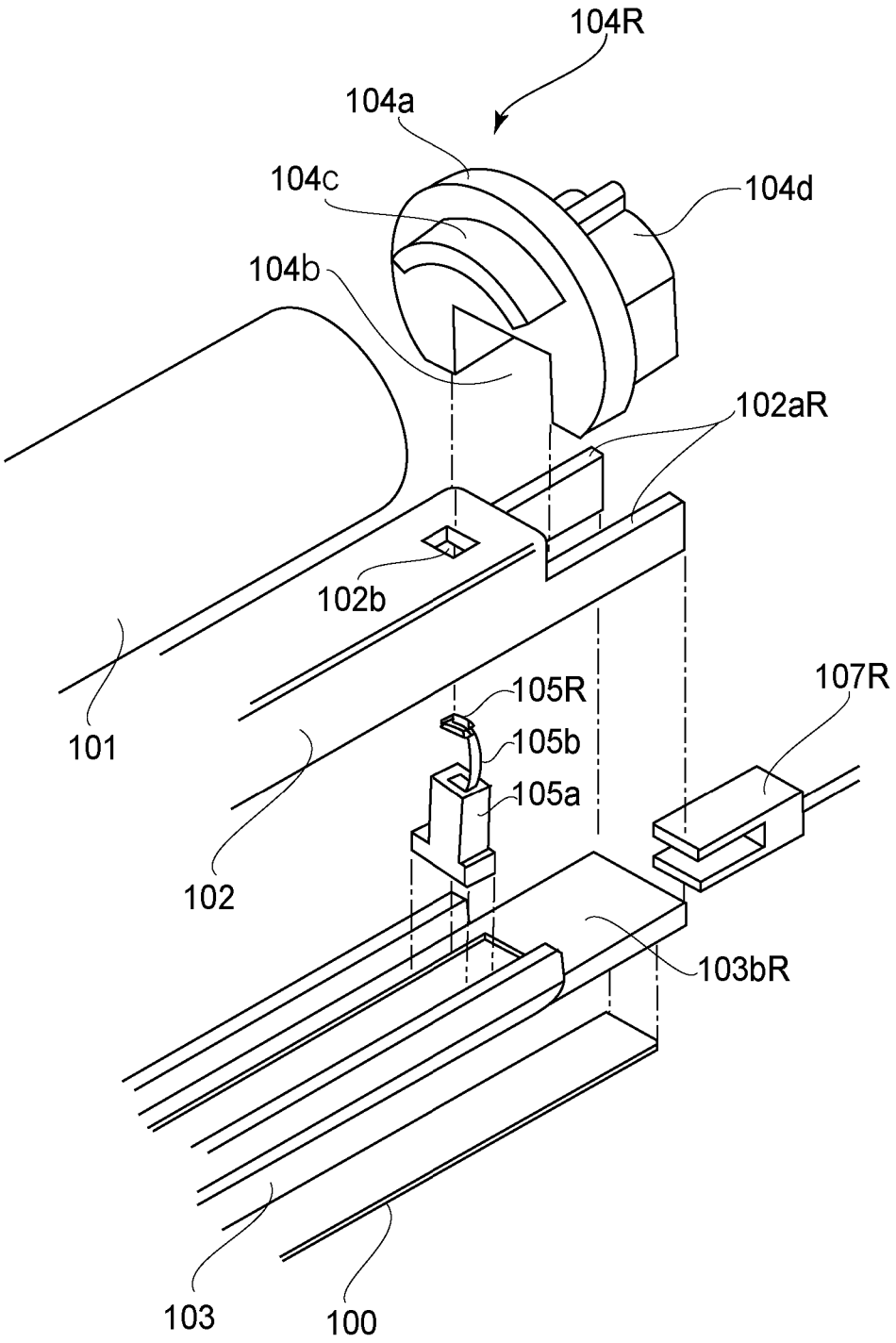
FIG. 5 is an exploded perspective view of the belt unit in a right side (the other end side).

FIG. 4 is an exploded perspective view of the belt unit 111 in a left side (one end side), and FIG. 5 is an exploded perspective view of the belt unit 111 in a right side (the other end side).

The belt unit 111 includes the cylindrical fixing belt 101. The belt unit 111 further includes a ceramic heater (heating member, heat generating source) 100, a back-up member (press-contact member) 103, a stay (reinforcing member) 102 and 3 (central portion, left side, right side) thermistors (detecting portions) 105C, 105F, 105R, which are provided inside the fixing belt (endless belt) 101. The belt unit 111 further includes left and right fixing flanges 104F, 104R. Each of the fixing belt 101, the ceramic heater 100, the back-up member 103 and the stay 103 is a long member extending in a left-right direction.

The fixing belt 101 is a heat-resistant member which functions as a heat-conductive member for conducting heat to the sheet P and which has a small thickness and flexibility. In order to improve a quick start property by decreasing a thermal capacity, as the fixing belt 101, it is possible to use a single-layer belt formed of PTFE, PFA, FEP or the like in a thickness of 100 μm or less, preferably 50 μm or less and 20 μm or more, for example. Further, it is also possible to use a composite-layer belt prepared by coating PTFE, PFA, FEP or the like on an outer peripheral surface of a layer of polyimide, polyamideimide, PEEK, PES, PPS or the like. Further, it is also possible to use a belt formed of metal.

In this embodiment, the fixing belt 101 which was prepared by forming an elastic layer on a cylindrical thin metal base layer and which had flexibility was used. In a free state, the fixing belt 101 assumed a substantially cylindrical shape by its own elasticity.

The ceramic heater (temperature raising portion) 100 has a basic constitution including an elongated thin plate-like ceramic substrate and an energization heat-generating resistor layer formed on a surface of the substrate and is a low-thermal capacity heater (heating portion) increasing in temperature with an abrupt rising characteristic in an entire effective heat-generating length region by energization to the heat-generating resistor layer. The heater 100 is engaged in and supported by a heater engaging groove portion 103*a* formed along a longitudinal direction of the back-up member 103 in an outer surface side of the back-up member 103.

The back-up member 103 is a molded member which has a substantially semi-circular cross-section and which is formed of a heat-resistant and heat-insulating material, and another surface thereof supporting the heater 100 slides with an inner peripheral surface of the fixing belt 101. The back-up member 103 is formed of a material having good insulating and heat-resistant properties, such as phenolic resin, polyimide resin, polyamide resin, polyamideimide resin, PEEK resin, PES resin, PPS resin, PFA resin, PTFE resins, or LCP resin.

The back-up member 103 not only holds the heater 100 but also has the function of realizing pressure application at the nip formed by the back-up member 103 press-contacted to the pressing roller 106 and feeding stability during rotation of the fixing belt 101.

The stay 102 is a rigid member for not only providing the back-up member with a longitudinal strength but also rectifying the back-up member by being pressed against an inner surface of a relatively soft back-up member formed of the resin material. In this embodiment, the stay 102 is formed of a metal molding material such as iron or aluminum having a U-shape in cross-section.

The fixing belt 101 is loosely fitted around an assembly of the back-up member 103 and the stay 102. Left side end portions (one end side end portions) 103*b*F, 102*a*F and right side end portions (the other end side end portions) 103*b*R, 102*a*R of the back-up member 103 and the stay 102 are extended and projected from left and right end portions toward outsides of the fixing belt 101, respectively.

The heater 100 has a length substantially corresponding to a full length portion of the back-up member 103 including the left and right extended end portions 103*b*F, 103*b*R. On each of heater substrate end portion surfaces corresponding to the left and right extended end portions 103*b*F, 103*b*R of the back-up member 103, an electrode portion for energization (not shown) exists.

The left and right fixing flanges 104F, 104R are engaged with the left and right extended end portions 102*a*F, 102*a*R of the stay 102 projected from the left and right end portions toward the outsides of the fixing belt 101. In this embodiment, the left and right extended end portions 102*a*F, 102*a*R of the stay 102 are engaged in holes 104*b* formed in the left and right fixing flanges 104F, 104R. As a result, the left and right fixing flanges 104F, 104R are engaged with the left and right extended end portions 102*a*F, 102*a*R of the stay 102, respectively.

Each of the left and right fixing flanges 104F, 104R includes a flange seat 104*a* for regulating (limiting) the end portion of the fixing belt 101 and an arcuate guiding portion 104*c* for guiding the inner peripheral surface of the end portion of the fixing belt 101. In a side opposite from the guiding portion 104*c* side of the flange seal 104*a*, a pressure-receiving portion 104*d* is provided. In a state in which the left and right fixing flanges 104F, 104R are engaged with the left and right extended end portions 102*a*F, 102*a*R of the stay 102, respectively, the guiding portions 104*c* are engaged into the left and right end portions of the fixing belt 101.

The 3 (central portion, left side, right side) thermistors 105C, 105F, 105R are temperature detecting members for detecting temperatures of the fixing belt 101 at a longitudinal central portion (widthwise central portion), a left side end portion (one end side) and a right side end portion (the other end side), respectively, in the inside of the fixing belt 101. The thermistors 105C, 105F, 105R are mounted inside the back-up member 103 at free end portions of leaf spring portions 105*b* fixedly mounted at their base portions on pedestals 105*a* provided at the longitudinal central portion, the left side end portion and the right side end portion, respectively.

The stay 102 is provided with holes (through holes) 102*b* at predetermined locations corresponding to the respective pedestals 105*a* in the back-up member 103 side. Each of the leaf spring portions 105*b* is projected toward the outside of the stay 102 through the associated hole 102*b*. Each of the thermistors 105C, 105F, 105R at the leaf spring free end portion is urged against the inner surface of the fixing belt 101 at a predetermined contact pressure by elasticity of the leaf spring portion 105*b*, thus detecting an inner surface temperature of the fixing belt 101. In this embodiment, the leaf spring portion 105*b*is formed of stainless steel and also constitutes an electrical conduction path for the associated thermistor (2-2) Pressing roller The pressing roller (rotatable driving member) 106 is constituted by a core metal 106*a* and a heat-resistant elastic layer 106*b* which is formed by molding in a roller shape coaxially with an axis of the core metal and which is coated on the core metal 106*b* with silicone rubber, fluorine-containing rubber, fluorine-containing resin, or the like. On the elastic layer 106*b*, a parting layer 106*c* is formed as a surface layer. As a material for the parting layer 106*c*, it is possible to select a material having good parting and heat-resistant properties, such as fluorine-containing resin, silicone resin, fluorosilicone rubber, fluorine-containing rubber, PFA, PTFE, FEP, or the like, for example.

The pressing roller 106 is provided so that left and right shaft portions 106*d* thereof are rotatably held between left and right side plates 112F, 112R of the fixing frame 112 via bearing members 113 formed of a heat-resistant resin material such as PEEK, PPS, a liquid crystal polymer or the like. At an end portion of the right side shaft portion 106*d*, a driving gear G is provided substantially concentrically integral with the shaft portion 106*d*. To the pressing roller 106, a driving force of a first motor M1 controlled by a controller 200 is transmitted via a drive transmitting mechanism (not shown). As a result, the pressing roller 106 is rotationally driven as the rotatable driving member at a predetermined peripheral speed in the clockwise direction indicated by an arrow R106 in FIG. 3.

The left and right side plates 112F, 112R of the fixing frame 112 are provided with slit portions 112*a*, in a mirror symmetrical manner, into which base portions of the pressure-receiving portions 105*d* of the left and right fixing flanges 104F, 104R. The slit portions 112*a* are guiding portions for slidably (movably) holding the pressure-receiving portions 104*d* of the fixing flanges 104F, 104R in directions in which the portions 104*d* move toward and away from the pressing roller 106.

In the belt unit 111, the heater 100 is disposed opposed to the pressing roller 106 substantially parallel to the pressing roller 106, and the pressure-receiving portions 105*d* of the left and right fixing flanges 104F, 104R are engaged in the slit portions 112*a*. Thus, to the pressure-receiving portions 104*d* of the left and right fixing flanges 104F, 104R, a predetermined pressure is applied by pressing mechanisms 109F, 109R, respectively.

Although a specific structure of each of the pressing mechanisms 109F, 109R is omitted from the figures, for example, an appropriate pressing mechanism such as a pressing mechanism including a pressing spring and a pressing plate, a pressing mechanism including a pressing cam or a pressing mechanism using an electromagnetic solenoid can be used. Further, it is also possible to use a mechanism capable of eliminating the pressure as desired.

By the pressure of the pressing mechanisms 109F, 109R, the stay 102, the back-up member 103, the heater 100 and the fixing belt 101 are press-contacted to the pressing roller 106 against the elasticity of the elastic layer 106*b*. As a result, between the fixing belt 101 and the pressing roller 106, the nip having a predetermined width with respect to the short direction is formed.

Electrical connectors 107F, 107R are inserted into the fixing flanges 104F, 104R through holes 104*e* provided in the pressure-receiving portions 104*d* of the fixing flanges 104F, 104R and are engaged with the left and right extended end portions 103*b*F, 103*b*R of the back-up member 103 supporting the heater 100. As a result, the heater 100 and a power source portion (energizing portion) 201 are electrically connected with each other, so that energization from the power source portion 201 to the heater 100 can be made.

Further, in this embodiment, also such a constitution that pieces of electrical information on detection temperatures of the thermistors 105C, 105F, 105R is fed back to the controller 200 via these electrical connectors 107F, 107R is employed.

(2-3) Air Blowing Cooling Unit

An air blowing cooling unit 120 as an air blowing portion is a mechanism portion for alleviating a degree of temperature rise by air blowing cooling at non-sheet passing portion (non-recording material passing portion) (i.e., end portion temperature rise) in each of one end side and the other end side of the fixing belt 101 with respect to the widthwise direction when a small-sized sheet having a width smaller than a width of a maximum width sheet usable in the apparatus is introduced in the fixing device.

The air blowing cooling unit 120 in this embodiment is provided in a side opposite from the pressing roller 106 side of the belt unit 111. The air blowing cooling unit 120 includes a unit substrate 121 mounted between the left and right side plates 112F, 112R of the fixing frame 112. The unit substrate 121 is provided with air blowing openings 122F, 122R in left and right end portion sides, respectively. The unit substrate 121 is further provided with shutter plates 61F, 61R for adjusting an opening width of the air blowing opening 122F, 122R by movement in the widthwise direction (longitudinal direction) of the fixing belt 101.

Although details of moving mechanisms for the shutter plates 61F, 61R are omitted from the figures, in this embodiment, a stepping motor (second motor) M2 controlled by the controller 200 so as to be driven in normal and reverse directions and a reciprocating portion which is driven by the motor M2 and which includes a pinion gear and a rack are provided. The shutter plates 61F, 61R are moved symmetrically in synchronism with each other by an operation of the reciprocating portion in a direction (opening direction) in which the opening widths of the air blowing openings 122F, 122R are broadened or a direction (closing direction) in which the opening widths of the air blowing openings 122F, 122R are narrowed with respect to the widthwise direction of the fixing belt 101 as indicated by arrows in FIG. 1.

Outside the unit substrate 122, fans (end portion cooling fans) 60F, 60R for blowing air toward the air blowing openings 122F, 122R are provided. The fans 60F, 60R are ON/OFF-controlled by the controller 200.

In FIG. 1, Wmin is a sheet passing portion width (sheet passing region width) of a minimum width sheet usable in the apparatus, and Wmax is a sheet passing portion width of a maximum width sheet usable in the apparatus. In this embodiment, feeding of the sheet P in the apparatus is made by the so-called center(-line) basis feeding. The minimum width (Wmin) sheet P is an A5R (148 mm×210 mm: short edge feeding) sheet, and the maximum width (Wmax) sheet P is an SRA (320 mm×450 mm: long edge feeding) sheet. Each of the opening widths of the air blowing openings 122F, 122R is set at a width corresponding to a non-sheet passing portion width when the minimum width sheet is passed through the fixing device 40.

Movement amount control of the shutter plates 61F, 61R is effected so that the opening widths of the air blowing openings 122F, 122R are adjusted to opening widths corresponding to non-sheet passing portion widths generated by the width of the associated one of sheets having various sizes from A5R to SRA.

Here, as a temperature detecting member for thermistor control of the heater 100, the central portion thermistor 105C detects the inner surface temperature of the fixing belt 101 in a region corresponding to passing region of the minimum width (Wmin) sheet. In this embodiment, the central portion thermistor 105C is disposed so as to detect the temperature of the fixing belt 101 at a portion corresponding to a substantially central portion with respect to the longitudinal direction (widthwise direction). Each of the left and right thermistors 105F, 105R is disposed as a temperature detecting member for detecting end portion temperature rise so as to detect the inner surface temperature of the associated fixing belt end portion corresponding to a region somewhat inside a region end line of the sheet passing region of the maximum width (Wmax) sheet.

That is, the left and right thermistors 105F, 105R are disposed so as to detect the temperatures of the fixing belt 101 in one end side and the other end side, respectively, with respect to the widthwise direction of the fixing belt in the inside of the fixing belt 101.

(2-4) Fixing operation

The controller 200 (also functioning as a discriminating portion) starts rotational drive of the pressing roller 106 on the basis of an image formation start signal (job execution signal) by actuating the first motor M1. By a frictional force generated at the nip N between the pressing roller 106 and the outer surface of the fixing belt 101 by the rotational drive of the pressing roller 106, a rotational force (rotational torque) acts on the fixing belt 101. As a result, the fixing belt 101 is rotated by the rotational drive of the pressing roller 106 at a peripheral speed substantially corresponding to the rotational peripheral speed of the pressing roller 106 in the counterclockwise direction indicated by an arrow R101, while the inner surface thereof slides with and is in intimate contact with the outer surface of the back-up member 103, including the heater 100, at the nip N.

In order to smooth the rotation of the fixing belt 101 by the pressing roller 106, it is preferable that a lubricant (not shown) is interposed at (applied onto) a mutual sliding portion between the fixing belt 101 and the outer surface of the back-up member 103 including the heater 100.

The controller 200 causes the power source portion 201 to supply electric power to the heater 100. As a result, the heater 100 abruptly increases in temperature, so that the fixing belt 101 rotating while sliding with the heater 100 at the inner peripheral surface thereof is heated. On the basis of detection information of the fixing belt temperature fed back from the central portion thermistor 105C, the controller 200 raises the fixing belt temperature to a predetermined fixing temperature. Then, the controller 200 controls electric power supplied to the heater 100 so that the fixing temperature is maintained, so that the temperature of the fixing belt 101 is controlled.

In this state of the fixing device 40, the sheet P on which the (unfixed) toner image T is carried is introduced from the secondary transfer portion 16 of the image forming portion 2, and is nip-fed through the nip N. As a result, the toner image T and the sheet P are heated and pressed by heat of the fixing belt 101 and the nip pressure, so that the toner image T is fixed as a fixed image on the sheet P. The sheet P nip-fed through the nip N is curvature-separated from the surface of the fixing belt 101 at a sheet exit of the nip N and then is discriminated and fed from the fixing device 40.

The air blowing cooling unit 120 is controlled in the following manner. When a job for continuously passing (introducing) small-sized sheets, having a width smaller than the width of the maximum width sheet usable in the apparatus, through the nip N is executed, end portion temperature rise (non-sheet passing portion temperature rise) in which the temperature of the fixing belt 101 at the non-sheet passing portion (non-recording material passing portion) becomes higher than the temperature of the fixing belt 101 at the sheet passing portion (recording material passing portion) occurs. The increased temperatures at left and right end portions of the fixing belt 101 are detected by the left and right thermistors 105F, 105R, respectively.

On the basis of pieces of temperature information fed back from the end portion thermistors 105F, 105R, when it is confirmed that the end portion temperatures reach a first set temperature (upper limit allowable temperature of the end portion temperature rise), the controller 200 turns on the fans 60F, 60R. In this embodiment, the first set temperature is 220° C.

Then, the controller 200 moves the shutter plates 61F, 61R so that the opening widths of the air blowing openings 122F, 122R become opening widths corresponding to the non-sheet passing portion widths formed by the small-sized sheet passed through the fixing device 40. The movement control of the shutter plates 61F, 61R may also be executed before the start of the job on the basis of width size information of a using sheet inputted into the controller 200 at the time of start of the image formation.

By the above-described turning-on of the fans 60F, 60R and movement control of the shutter plates 61F, 61R, air blowing cooling (end portion cooling) of the fixing belt 101 in the non-sheet passing region depending on the width size of the using sheet is made, so that the end portion temperatures of the fixing belt 101 are lowered. That is, the air blowing cooling unit 120 cools the fixing belt 101 by blowing air toward the fixing belt 101 in arrow d directions in FIG. 1 in the non-sheet passing region.

When it is confirmed by the end portion thermistors 105F, 105R that the end portion temperatures are lowered by the above air blowing cooling to a predetermined second set temperature, i.e., 170° C. in this embodiment, lower than the first set image, the controller 200 turns off the fans 60F, 60R. That is, the end portion cooling of the fixing belt 101 is stopped.

As described above, during the continuous sheet passing job of the small-sized sheets, when the end portion thermistors 105F, 105R confirm that the fixing belt end portion temperatures increase up to the predetermined first set temperature, the controller 200 turns on the fans 60F, 60R to start the air blowing cooling. Then, when the end portion thermistors 105F, 105R confirm that the fixing belt end portion temperatures decrease down to the predetermined second set temperature, the controller 200 turns off the fans 60F, 60R to stop the air blowing cooling. Then, by repeating the start and the stop of the above-described air blowing cooling until the job ends, a degree of the end portion temperature rise is alleviated.

In the case where the passed sheet is the maximum width sheet usable in the fixing device 40, even when the job is the continuous sheet passing job, the temperature of the fixing belt 101 is controlled substantially over a full width to the predetermined fixing temperature on the basis of the detection information fed back from the central portion thermistor 105C. For that reason, the end portion temperature rise does not generate and the turning-off state of the fans 60F, 60R is maintained, so that the end portion cooling of the fixing belt 101 is not performed.

(3) Abnormal Detection of Fixing Belt

A detecting method in the case where the fixing belt 101 caused abnormality, i.e., crack (breakage) will be described. In this embodiment, in the following case, the controller (discriminating portion) 200 discriminates that the breakage of the fixing belt 101 occurred. That is, in the case where a difference in detection temperature between the left and right thermistors 105F, 105R is a predetermined temperature difference in a state in which the air blowing cooling unit 120 is actuated due to the end portion temperature rise caused by continuously passing the small-sized sheets through the fixing device 40, the controller 200 is notified of an abnormality of the fixing belt 101.

Figure 6:
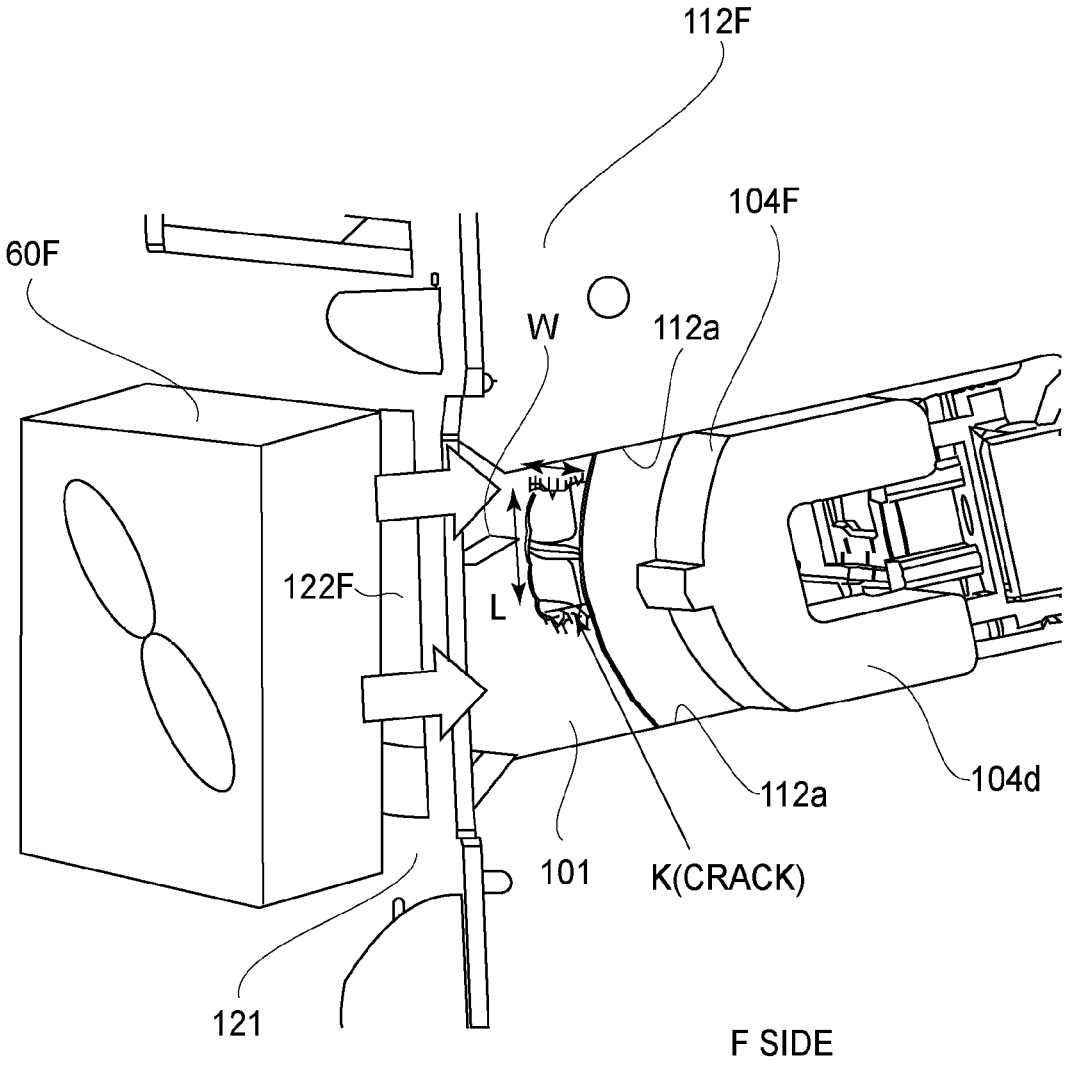
FIG. 6 is an illustration of a crack.

This will be described using the case where the crack (breakage) K occurs only at the left side (F side) end portion of the fixing belt 101 as shown in FIG. 6. In FIG. 6, a crack length of the fixing belt 101 with respect to the longitudinal direction (widthwise direction) is W, and a crack length of the fixing belt 101 with respect to a circumferential direction is L.

As described above, when small-sized sheets (A4-sized sheet, 80 gsm, short edge feeding in this embodiment) are continuously passed through the fixing device 40 to cause end portion temperature rise and the left and right thermistors 105F, 105R detect not less than 220° C. as the predetermined first set temperature, the air blowing cooling unit 120 is actuated. That is, the fans 60F, 60R are turned on, so that the air is blown from the fan 60F (60R) in an arrow direction in FIG. 6 and thus end portion cooling is effected.

In the case where the crack K does not occur in either of the left side or the right side, both of the detection temperatures of the left and right thermistors 105F, 105R, with temperature lowering of the belt 101 by the end portion cooling progress, detect substantially the same value (temperature lowering gradient). That is, the detection temperatures of the left and right thermistors 105F, 105R at the same point of time are the substantially same value, and even when there is a temperature difference between the detection temperatures, the temperature difference is, e.g., about 5° C. in actuality, i.e., is small.

However, in the case where the crack K occurs at one of the left and right end portions in the left side (F side) in an example of FIG. 6 or in the case where the crack K has already occurred, the wind of the fan 60F enters an inside of the fixing belt 101 through the crack K. For that reason, the wind of the fan 60F directly blows against the inner surface of the fixing belt 101 and the left side thermistor 105F. On the other hand, there is no crack at the end portion in the right side (R side), and therefore the wind of the fan 60R does not enter the inside of the fixing belt 101, so that the wind of the fan 60R does not directly blow against the inner surface of the fixing belt 101 and the right side thermistor 105R.

For that reason, the temperature lowering gradient of the detection temperature of the left side thermistor 105F with the end portion cooling of the fixing belt 101 is considerably larger than the temperature lowering gradient of the detection temperature of the right side thermistor 105R, i.e., the left and right thermistors 105F, 105R are in an unbalanced temperature lowering state. That is, there arises such a situation that the temperature difference between the detection temperatures of the left and right thermistors 105F, 105R, at the same point of time with the temperature lowering of the fixing belt 101 by the end portion cooling, is substantial.

This embodiment focuses on this phenomenon and employs a constitution in which in the case where the thermistor difference between the detection temperatures of the left and right thermistors 105F, 105R is a predetermined temperature difference, the controller 200 discriminates that the fixing belt 101 is abnormal (occurrence of crack) and notifies the abnormality (crack occurrence).

Control for detecting the crack occurrence of the fixing belt 101 in this embodiment will be described using a flowchart of FIG. 7. This control is effected by the controller 200 under a condition in which the fans 60F, 60R of the air blowing cooling unit 120 are turned on during the continuous sheet passing of the small-sized sheets. That is, in this embodiment, in the case where the temperature difference between the detection temperatures of the left and right end portion thermistors 105F, 105R under this condition is not less than 30° C. as the predetermined temperature difference in this embodiment, the controller (discriminating portion) 200 detects that an abnormality is generated. Control of devices (members) other than the fixing device 40 will be omitted.

Step B: Energization to the heater 100 is made, and the motor M1 is rotated, so that the fixing device 50 is actuated.

Step C: Whether or not the thermistors 105C, 105F, 105R at the central portion and the left and right end portions normally operate is checked.

If the thermistors do not normally operate, the fixing device 40 or the thermistors 105C, 105F, 105R cause abnormality, and therefore the operation of the image forming apparatus 1 is stopped (step K).

Step D: In the case where the thermistors 105C, 105F, 105R normally operate, sheet passing through the fixing device 40 (continuous sheet passing job of set small-sized sheets) is started.

Step E: During the sheet passing, whether or not the detection temperature TF1 or TR1 of the left or right thermistor 105F or 105R disposed in the non-sheet passing region is not less than 220° C. as the predetermined first set temperature is checked.

Step F: In the step E, in the case where the detection temperature is not less than 220° C., the fans 60F, 60R of the air blowing cooling unit 120 are turned on. The shutter plates 61F, 61R are moved so that the opening widths of the air blowing openings 122F, 122R of the air blowing cooling unit 120 are opening widths corresponding to the non-sheet passing portion widths formed by the small-sized sheets passed through the fixing device 40. As a result, the end portion cooling of the fixing belt 101 is made.

Step G: Whether or not a temperature difference T2 between the detection temperatures of the left and right thermistors 105F, 105R is less than 30° C. as a predetermined temperature difference is checked. That is, whether or not the fixing belt 101 causes abnormality (crack occurrence) is discriminated.

In the case of T2≥30° C. (in the case where T2 is not less than the predetermined thermistor difference), the controller 200 discriminate that the crack K occurs in the left end portion side or the right end portion side of the fixing belt 101, and then stops the operation of the image forming apparatus 1 including the fixing device 40 (step K).

Steps H, I: In the step G, in the case of T2<30° C., the controller 200 discriminates that there is no abnormality in the fixing belt 101, and continues the end portion cooling of the fixing belt 101 in the step F. Then, when both of the detection temperatures of the left and right thermistors 105F, 105R are less than 170° C. in this embodiment as a predetermined second set temperature lower than the first set temperature, the fans 60F, 60R are turned off. That is, further end portion cooling is stopped.

Figure 8:
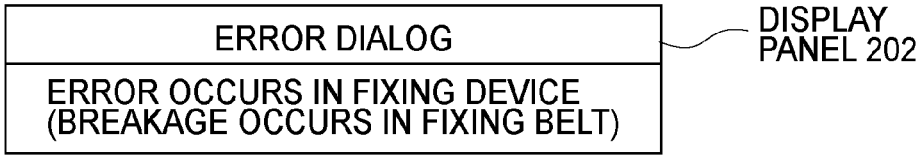
FIG. 8 is a schematic view of abnormal notification on a display panel.

Step J: Then, the steps E to I are repeated until the sheet passing ends. In the case of the operation stop of the image forming apparatus 1 in the step K, such a message as shown in FIG. 8 is displayed on a display panel 202 of the image forming apparatus 100 or on a monitor (not shown) of a PC (personal computer) connected with the image forming apparatus 1. That is, the controller 200 notifies the abnormality to a user.

Figure 7:
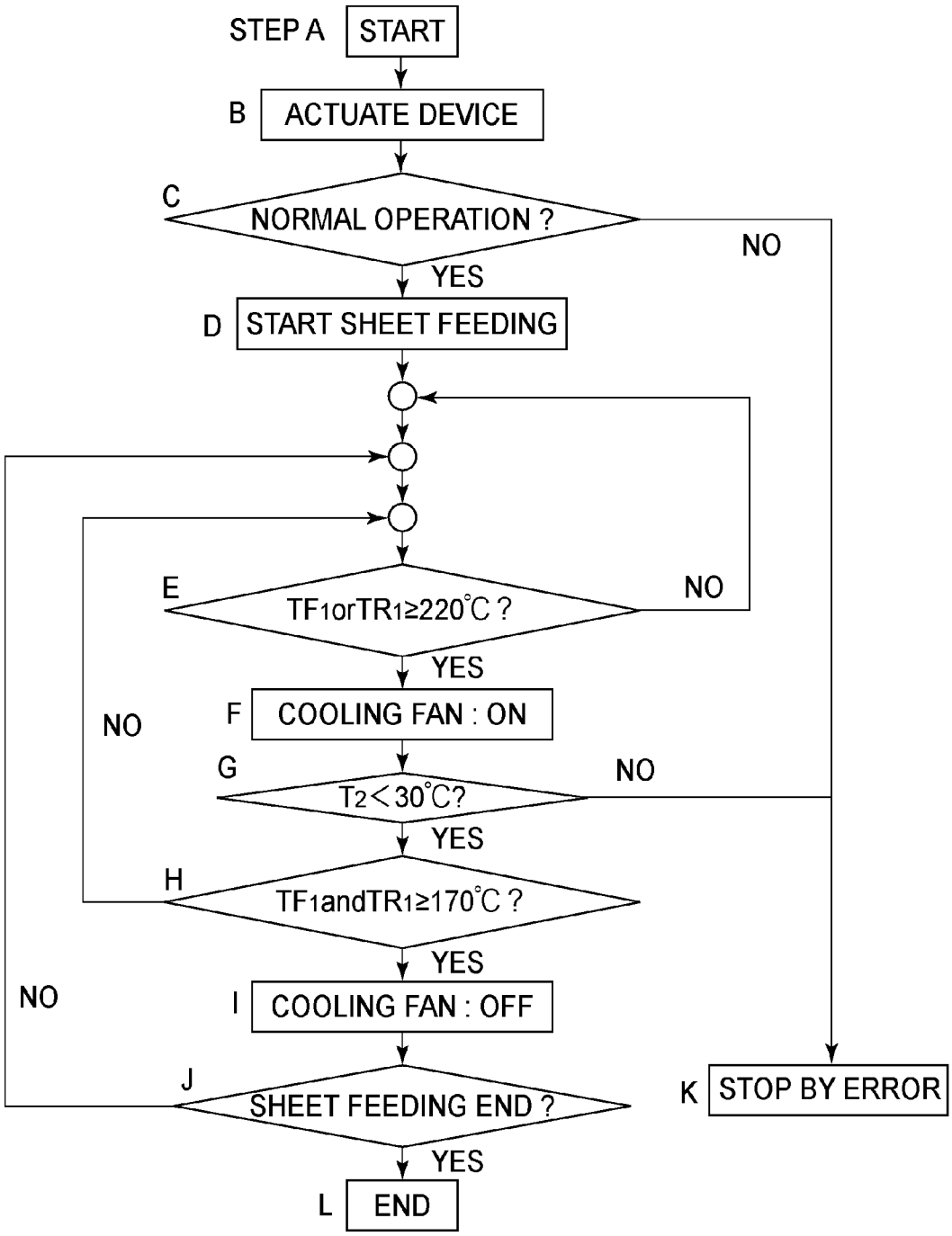
FIG. 7 is a flowchart of an operation in a control mode.
Figure 12:
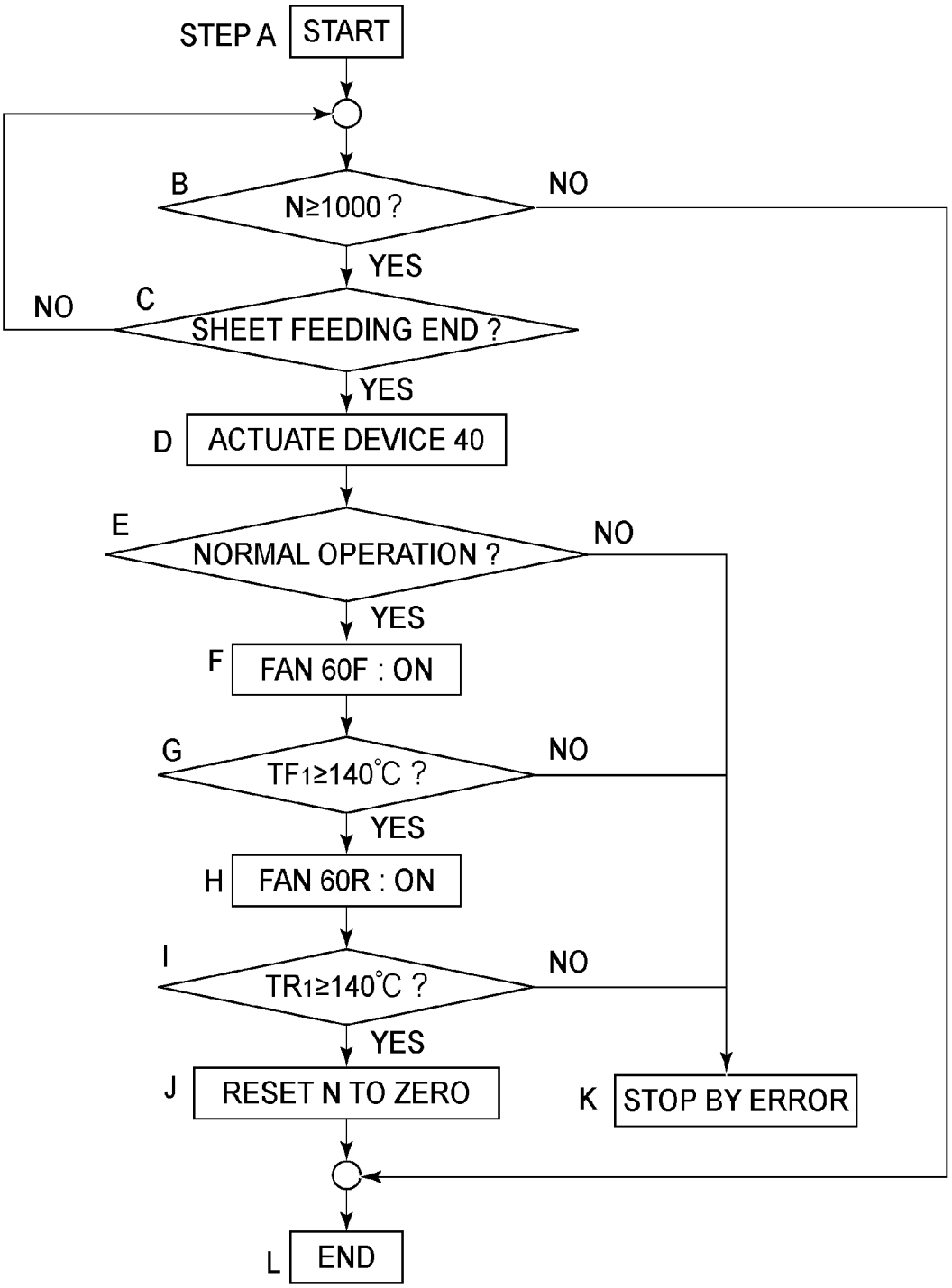
FIG. 12 is a flowchart of an operation in a control mode in Embodiment 3.

Here, in the step C in FIG. 7, if the thermistors 105C, 105F, 105R" operate in a "normal operation," this means that "an actuation operation of the fixing device is normally performed and the thermistors 105C, 105F, 105R operate in a state in which the thermistors detect normal values". The detecting operation itself of the thermistors is such that the temperature detection is made in contact with the fixing belt and whether or not the fixing device performs the actuation operation normally is checked depending on whether or not the temperature gradient at a certain time is within an allowable value range. This is true for flowcharts of FIGS. 10 and 12 described later.

Progression of the detection temperatures of the thermistors 105F, 105R until the abnormality of the fixing belt 101 is detected by the temperature difference between the detection temperatures of the left and right thermistors 105F, 105R will be described with reference to FIG. 9.

Figure 9:
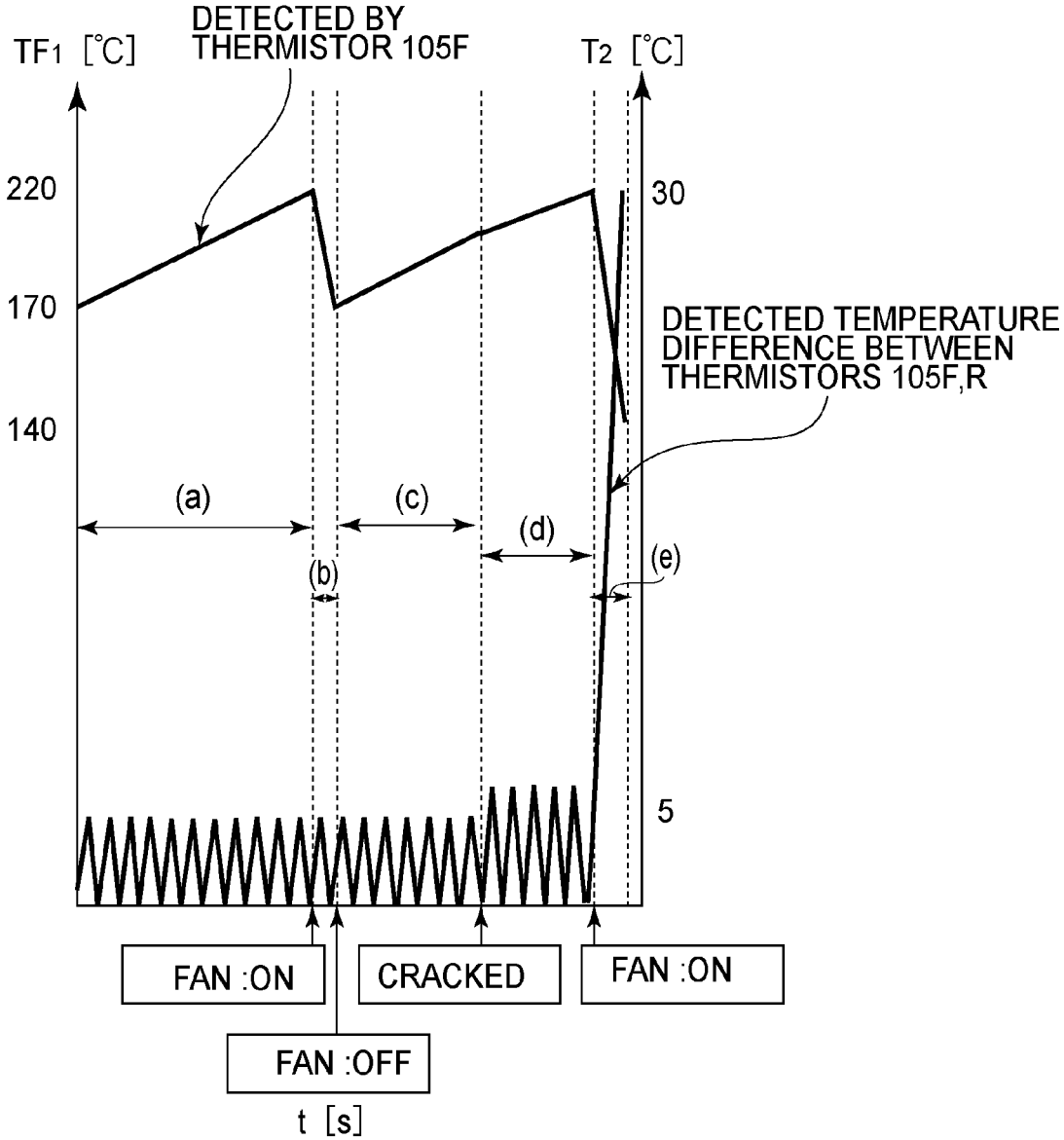
FIG. 9 is a graph showing a detection temperature of a thermistor.

FIG. 9 is a graph showing the detection temperature of the left side thermistor 105F and the temperature difference between the detection temperatures of the left and right thermistors 105F, 105R in the case where the crack K occurs at the end portion of the fixing belt 101 in the left side. The abscissa represents a time t(s), the left side ordinate represents a detection temperature TF1 (° C.) of the left side thermistor 105F, and the right side ordinate represents a detection temperature difference T2 (° C.) between the detection temperatures of the left and right thermistors 105F, 105R.

Progression (a): In this state, no crack K occurs in the fixing belt 101 and the fans 60F, 60R are in the turned-off state and the small-sized sheets are passed through the fixing device 40. The detection temperature TF1 of the left side thermistor 105F gradually increases from 170° C. Further, in this state, the detection temperature difference T2 between the left and right thermistors 105F, 105R falls within 5° C.

Progression (b); In this state, the detection temperature of the left side thermistor 105F reaches 220° C., and the fans 60F, 60R are turned on. The wind is set toward the fixing belt 101, and the fans are kept in the ON state until the detection temperature of the left side thermistor 105F reaches 170° C. Also in this state, the detection temperature difference between the left and right thermistors 105F, 105R falls within 5° C.

Progression (c): In this state, the sheet passing is further continued in a state in which the detection temperature of the left side thermistor 105F lowers to 170° C. and then the fans are turned off. Similarly as in the progression (a), the detection temperature of the left side thermistor 105F gradually increases from 170° C.

Progression (d): In this state, the crack K occurs at the left side end portion of the fixing belt 101 during the sheet passing from the state of the progression (c). In the state in which the fan 60F is turned off, the detection temperature difference between the left and right thermistors 105F, 105R gradually increases similarly as in the progression (a). At this time, the detection temperature difference between the left and right thermistors 105F, 105R falls within 7° C. In a conventional fixing device, when the detection temperature difference between the left and right thermistors 105F, 105*r* is changed from 5° C. to 7° C., the changed difference falls within a range (±3° C.) of a variation in detection temperature of the end portion thermistor. For that reason, it was difficult to detect the crack occurrence of the fixing belt 101 in this state.

Progression (e): When the thermistor detection temperature reaches 220° C. from the state of the progression (d) and the fans are in the turned-on state, different from the state of the progression (b), the wind of the fan enters the inside of the fixing belt 101 and directly blows against also the left side thermistor 105F. For that reason, the detection temperature of the left side thermistor 105F is smaller than the detection temperature of the right side thermistor 105R in the right side where no crack occurs, so that compared with the state of the progression (b), the detection temperature difference between the left and right thermistors 105F, 105R becomes large.

In this embodiment, in a state in which the detection temperature difference between the left and right thermistors 105F, 105R is 30° C. or more, the controller 200 discriminates that the crack K occurs in the fixing belt 1 and then stops the operation of the image forming apparatus.

In a conventional image forming apparatus, the abnormality could not be detected until the size of the crack K of W=1 mm and L=1 mm generated in the fixing belt of 30 mm in diameter grows to W=15 mm and L=45 mm. Compared with this case, in this embodiment, in the case where the fixing belt 101 of 250 mm/s in feeding speed and 30 mm in diameter is used in the fixing device, the abnormality can be detected before the size of the crack K grows to about W=10 mm and L=10 mm.

In this embodiment, the case where the crack K occurs in the left side end portion of the fixing belt 101 was described as an example, but even in the case where the crack K occurs in the right side end portion, the crack K is detectable by the right side thermistor 105R similarly as in the case where the crack K occurs in the left side end portion.

[Embodiment 2]

In this embodiment, when the number of sheets subjected to continuous image formation of the image forming apparatus 1 or subjected to continuous sheet passing through the fixing device 40 (an integrated number of sheets introduced into the fixing device 40) reaches a certain number (1000 sheets in this embodiment), after the sheet passing operation is ended, detection control in which whether or not the crack K occurs in the fixing belt 101 is checked is effected. Also, in this embodiment, similarly as in Embodiment 1, the case where the crack K occurs at the left side end portion of the fixing belt 101 will be described. In this embodiment, portions identical to those in Embodiment 1 will be omitted from description.

Figure 10:
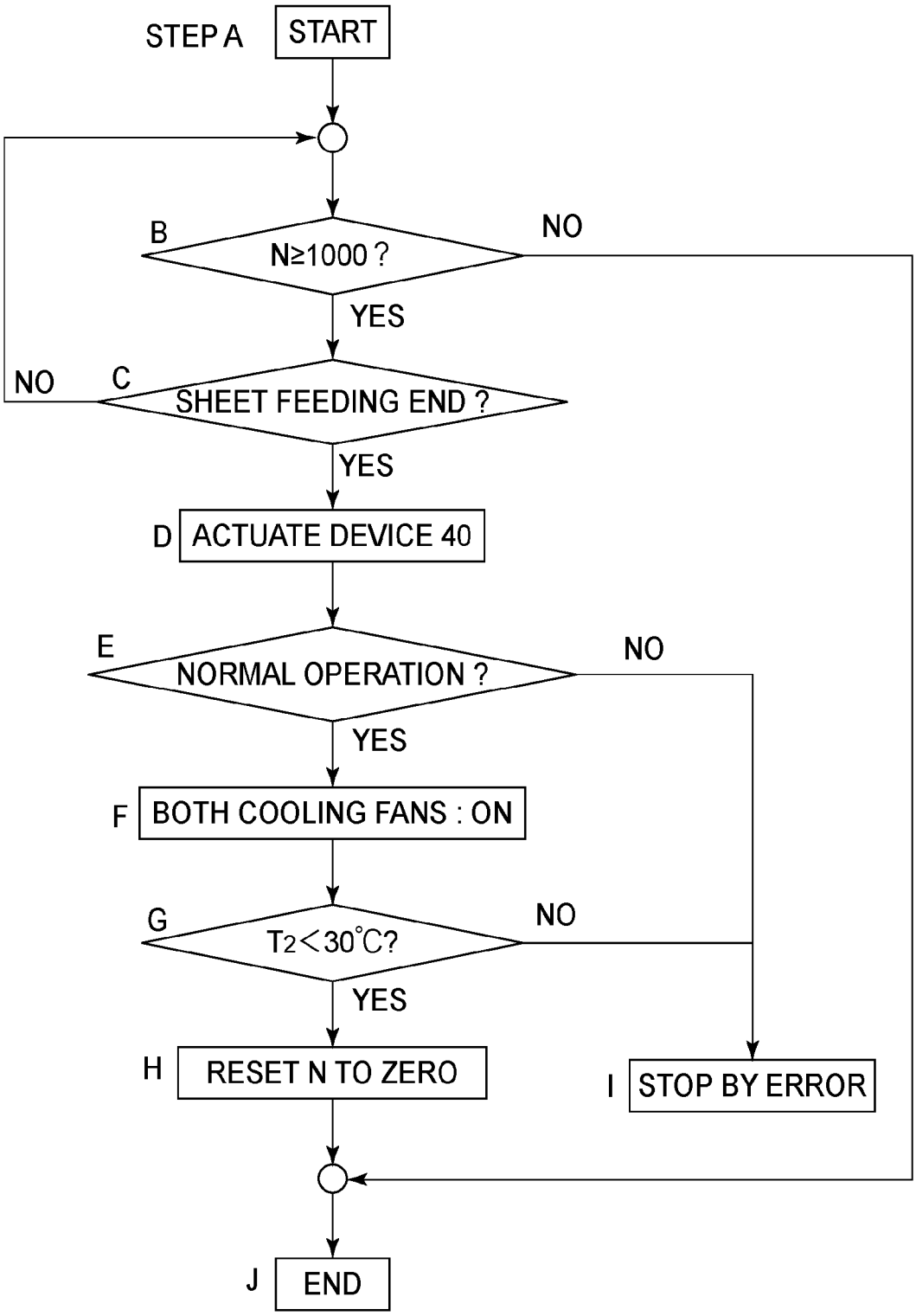
FIG. 10 is a flowchart of an operation in a control mode in Embodiment 2.

Control for detecting the occurrence of the crack K in the fixing belt 101 in this embodiment will be described using a flowchart of FIG. 10 and a progression graph of detection temperatures of the left and right thermistors 105F, 105R in FIG. 11 in the case where this embodiment is used.

The controller 200 includes a counter function portion for integrating (counting) the number of sheets introduced into the fixing device 40. A count value (sheet passing count number) of the integrated number of the sheets is N. In this embodiment, a predetermined threshold of the count value N is 1000 sheets. Then, when the count value is N≥1000 (not less than the predetermined threshold), the fixing device 40 is actuated, and the air blowing cooling unit 120 is placed in an actuated state. In this state, in the case where the temperature difference in detection temperature between the left and right thermistors 105F, 105R is a predetermined temperature difference, the controller 200 notifies abnormality of the fixing belt 101 to the user. This sequence will be described using a control flowchart of FIG. 10.

Step B: N≥1000 is detected.

Steps C, D: After whether or not the sheet passing operation by the image forming apparatus is ended is checked, the fixing device 40 is actuated again.

Step E: Whether or not the thermistors 105C, 105F, 105R at the central portion and the left and right end portions normally operate is checked.

If the thermistors do not normally operate, the fixing device 40 or the thermistors 105C, 105F, 105R cause abnormality, and therefore the operation of the image forming apparatus 1 is stopped (step I).

Figure 11:
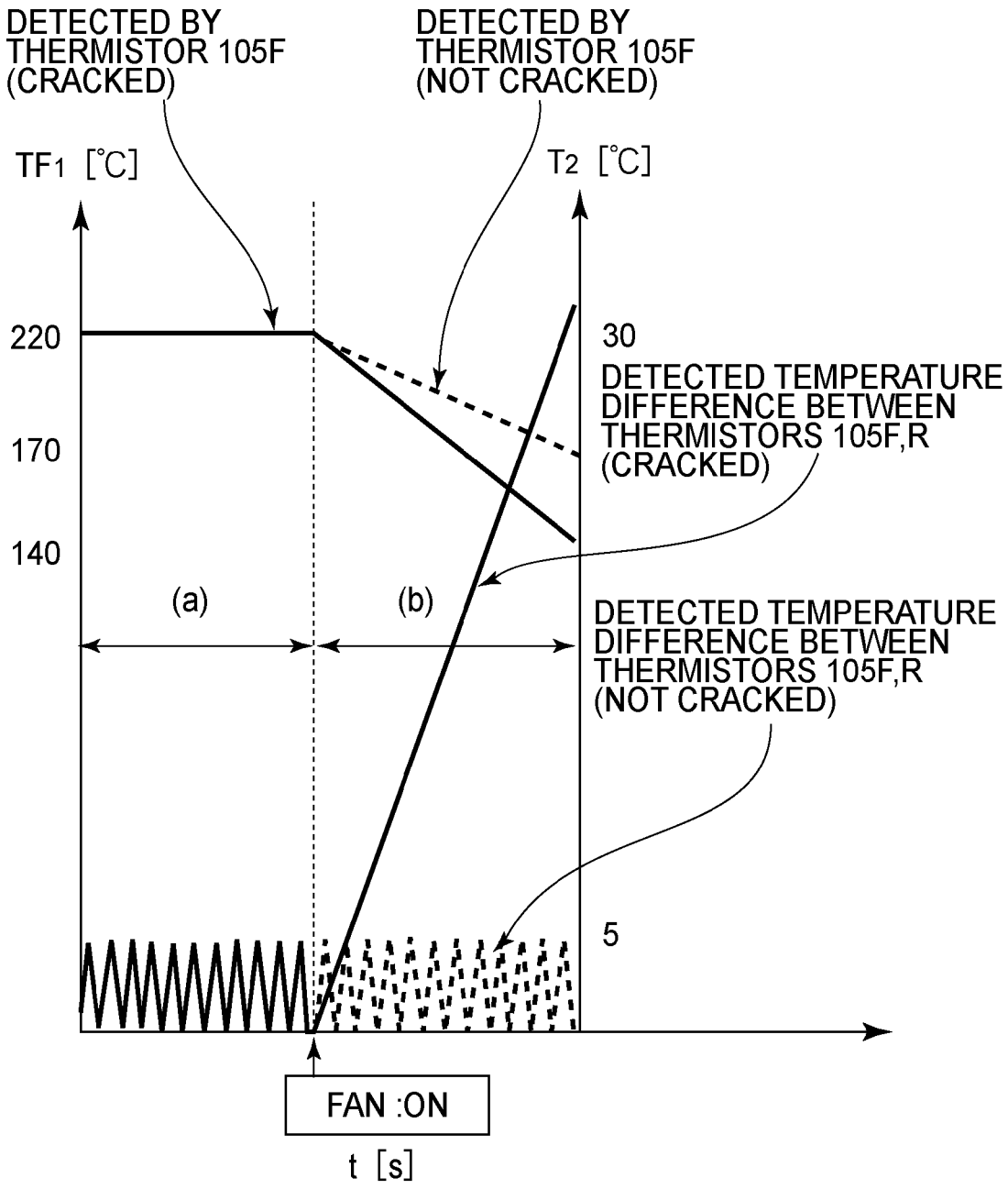
FIG. 11 is a graph showing a detection temperature of a thermistor.

A detection temperature TF1 of the left side thermistor 105F and a detection temperature difference between the left and right thermistors 105F, 105R in the states of the steps D, E are shown as progression (a) in FIG. 11.

In this embodiment, the actuation of the fixing device 40 is made so that the detection temperatures of the left and right thermistors 105F, 105R in the state of the steps D, E are 220° C. At this time, the detection temperature difference between the left and right thermistors 105F, 105R falls within 5° C.

Step F: The fans 60F, 60R are turned on for a predetermined time (10 sec in this embodiment).

Step G: Whether or not the detection temperature difference T2 between the left and right thermistors 105F, 105R is less than 30° C. is checked.

As shown in progression (b) of FIG. 11, when the fans 60F, 60R are turned on for the pressing roller time (10 sec in this embodiment), in the case of no occurrence of the crack, as indicated by a broken line in FIG. 11, the detection temperature of the left side thermistor 105F lowers to less than 170° C. At this time, although the detection temperature difference T2 between the left and right thermistors falls within 5° C. as indicated by a broken line in FIG. 11 in the case of no occurrence of the crack, the detection temperature difference T2 is 30° C. or more as indicated by a solid line in FIG. 11 in the case where the crack occurs.

As a result, if T2≥30° C. is satisfied in the state of the step G, the controller 200 discriminates that the crack occurs in the fixing belt 101 in the neighborhood of the left side thermistor 105F and then stops the operation of the image forming apparatus (step I).

In the step I, in the case where the operation of the image forming apparatus is stopped, the message shown in FIG. 8 in Embodiment 1 is displayed on the display panel 202 of the image forming apparatus or on the monitor of the PC connected with the image forming apparatus, so that the controller 200 notifies abnormality of the image forming apparatus to the user.

Step H: After the execution of the detection of the detection temperature difference T2 in the step G, the count value N is reset.

In this embodiment, even in the case where the control in Embodiment 1 is not effected, i.e., even under a sheet passing condition, which is a condition in which the fans 60F, 60R are not turned on, in which the state that the detection temperature of the left and right thermistors 105F, 105R is less than 220° C. is continued, the crack K can be detected early.

By applying this embodiment to the image forming apparatus, even under the sheet passing condition in which the end portion cooling fans are not turned on during the sheet passing as in Embodiment 1, the crack occurred in the fixing belt can be found out earlier than the conventional fixing device.

In the above, the actuation of the fixing device 40 and the detection of the detection temperature difference T2 by the actuation of the fans 60F, 60R can also be executed at any time on the basis of an input signal from a manually operating portion 203, operated by the user, to the controller 200.

[Embodiment 3]

In this embodiment, the left and right fans 60F, 60R are turned on independently to effect detection control as to whether or not the crack K occurs in the fixing belt 101. This detection control will be described. In this embodiment, portions identical to those in Embodiment 2 will be omitted from description, and similarly as in Embodiment 1, the case where the crack K occurs in the left side end portion of the fixing belt will be described.

In this embodiment, in a state in which the fixing device 40 is actuated and the air blowing cooling unit 120 is operated, in the case where at least one of detection temperatures of the left and right thermistors 105F, 105R is not a predetermined threshold temperature or more, the controller 200 notifies abnormality of the fixing belt 101 to the user. This sequence will be described using a control flowchart of FIG. 12. When a sheet passing count number in the image forming apparatus is N, the case of N ≥1000, control means in this embodiment functions.

Step B: N≥1000 is detected.

Steps C, D: After whether or not the sheet passing operation by the image forming apparatus is ended is checked, the fixing device 40 is actuated again.

Step E: Whether or not the thermistors 105C, 105F, 105R at the central portion and the left and right end portions normally operate is checked.

If the thermistors do not normally operate, the fixing device 40 or the thermistors 105C, 105F, 105R cause abnormality, and therefore the operation of the image forming apparatus 1 is stopped (step K).

Steps F, G: The fan 60F is turned on for a predetermined time (10 sec in this embodiment), and then whether or not the detection TF1 of the left side thermistor 105F is TF1≥140° C. (predetermined threshold temperature or more) is checked.

If the detection temperature TF1 is less than 140° C. (in the case where the detection temperature TF1 is not predetermined threshold temperature or more), the controller 200 discriminates that the crack K occurs in the fixing belt 101 and then stops the operation of the image forming apparatus (step K).

Steps H, I: In the case of TF1≥140° C. in the step G, the right side fan 60R is turned on for a predetermined time (10 sec in this embodiment), and then whether or not the detection temperature TR1 of the right side thermistor 105R is TR1≥140° C. is checked.

If the detection temperature TR1 is less than 140° C., there is a possibility that the crack K occurs in the fixing belt 1, and therefore the operation of the image forming apparatus is stopped (step K).

Step J: The count value N is reset.

The order of the steps F, G, H, I in the flowchart in this embodiment may also be that of the steps H, I, F, G, and also in this case, a similar effect is obtained. Further, even when the steps F, G and the steps H, I are executed in parallel, the similar effect is obtained.

In the case of this embodiment, not only the case where the crack occurs in only one of the left and right sides of the fixing belt 101 can be detected as in Embodiments 1 and 2, but also even in the case where the crack occurs in both of the left and right sides of the fixing belt 101, the occurrence of the crack can be found out earlier than the conventional fixing device.

In the above, the actuation of the fixing device 40 and the detection of the detection temperature by the actuation of the fans 60F, 60R can also be executed at any time on the basis of an input signal from a manually operating portion 203, operated by the user, to the controller 200.

[Embodiment 4]

In this embodiment, different from the constitutions in Embodiments 1 to 3 in which the detect 40 includes the two fans 60F, 60R, a constitution in which the wind is blown from a single fan 60 to non-sheet passing regions in both end sides of the fixing device 40 through a duct 70 is employed. In this embodiment, portions identical to those in Embodiments 1 to 3 will be omitted from description.

Figure 13:
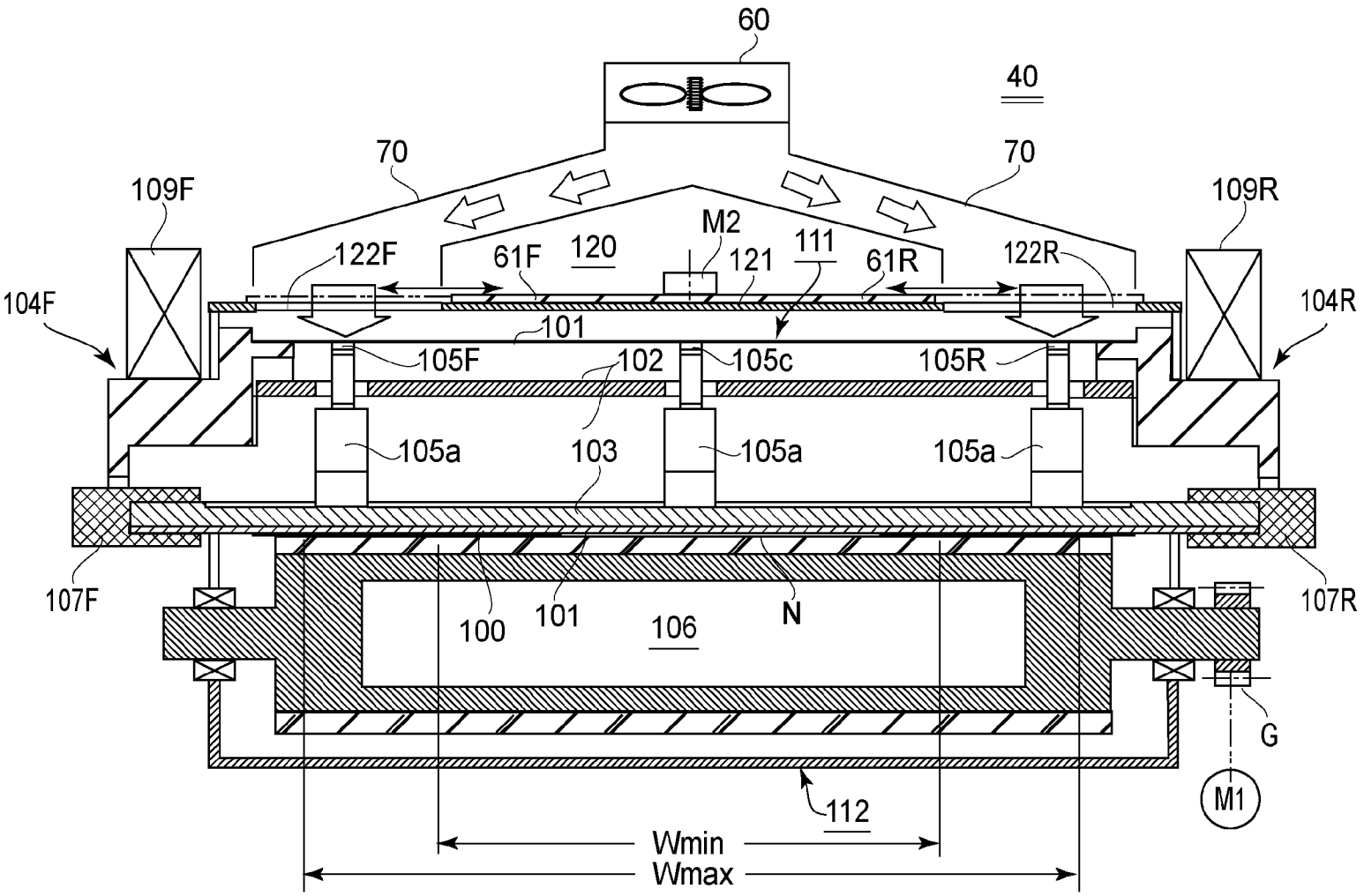
FIG. 13 is a schematic longitudinal sectional front view of a principal part of a fixing device in Embodiment 4.

FIG. 13 shows a structure of an air blowing cooling unit 120 in the fixing device 40. The wind blown from the single fan 60 is introduced to both end portions of the fixing device 40 by a bifurcated duct 70. In this case, the air blowing cooling unit 120 is used under a condition in which speeds and amount of the wind introduced to the both end portions of the fixing device 40 through the bifurcated duct 70 are equal to each other. By applying this embodiment to the image forming apparatus, even in the case of the single fan, the crack occurred in the fixing belt 101 can be found out earlier than the conventional fixing device.

As described above, according to the above-described embodiments, the crack occurred in the fixing belt can be found out early, so that abnormality of the fixing device can be found out before an image defect generates. In addition, compared with the conventional fixing device, the crack can be detected before the crack grows to damage other parts, and therefore it is possible to realize reductions in running cost and downtime and improvement in reliability of the fixing device.

[Other Embodiments]

The present invention is not limited to the embodiments described above, but may also be applicable to other embodiments appropriately modified from the above-described embodiments. In addition, numbers, positions, shapes and the like of constituent elements are not limited to those in the above-described embodiments, but may also be changed to those suitable for carrying out the present invention.

1) In the above-described embodiments, the image forming apparatus in which the endless belt 101 is rotated by the rotational driving of the pressing roller 106 which is the rotatable driving member as the nip-forming member was described, but the present invention is not limited to this device constitution. For example, the endless belt 101 may also have such a device constitution that the endless belt 101 is extended and stretched among a plurality of supporting members including a driving roller and is rotationally driven.

2) Also the nip-forming member 106 may also be a rotatable endless belt member.

3) The constitution of the temperature raising portion for raising the temperature of the belt 101 is not limited to the constitution using the ceramic heater in the above-described embodiments. Various internal heating constitutions or external heating constitutions can be used. For example, it is also possible to employ a means constitution in which the belt 101 is heated from an inside or an outside using a halogen heater (halogen lamp) as a heat source or a means constitution in which the belt 101 is heated through electromagnetic induction heating by an exciting coil provided inside or outside the belt 101. Further, such a means constitution that an energization-generating layer is provided in a belt itself and the belt is heated by heat generation of the layer may also be employed.

4) The use of the image heating apparatus of the present invention is not limited to the use as the fixing device for heat-fixing the (unfixed) toner image as a fixed image on the sheet P under heat and pressure as in the above-described embodiments. The image heating apparatus of the present invention is also effective as a heat-treating device for adjusting a surface property of an image in such a manner that the image (fixed image or temporarily fixed image) once or temporarily fixed on the sheet is heated and pressed to improve glossiness.

5) The controller is not limited to the controller (control means) having the functions of effecting control as to image formation of the image forming apparatus and control as to fixing. The controller 200 may also be the controller exclusively effecting control of the fixing device (image heating apparatus) 40.

6) The fixing device (image heating apparatus) 40 is not limited to the fixing device fixed inside the image forming apparatus. The fixing device 40 may also be constituted as a unit which is demountable to the outside of the image forming apparatus and which is then replaceable. In this case, the unit may also be demountable and replaceable in the form including the controller 200 or in the form excluding the controller 200. The image heating apparatus of the present invention may also be used alone independently of the image forming apparatus.

7) The type of the image forming portion of the image forming apparatus is not limited to the electrophotographic type, but the image forming portion may also be an appropriate image forming process means of an electrostatic recording type or a magnetic recording type. Further, the type of the image forming apparatus is not limited to the transfer type, but may also be another type in which the (unfixed) image is directly formed on a sheet such as an electrofax sheet or electrostatic recording paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2014-248814 filed on Dec. 9, 2014 and 2015-220240 filed on Nov. 10, 2015, which are hereby incorporated by reference Herein in their entirety.

What is claimed is:

1. An image heating apparatus comprising:

an endless belt configured to heat a toner image on a sheet;

a temperature raising portion configured to raise a temperature of said endless belt;

a first detector configured to detect the temperature of said endless belt at a widthwise central portion of said endless belt;

a controller configured to control energization to said temperature raising portion depending on an output of said first detector;

a second detector configured to detect the temperature of said endless belt at one widthwise end portion of said endless belt;

an air blower configured to blow air depending on an output of said second detector to cool the one widthwise end portion of said endless belt; and a discriminating portion configured to discriminate whether or not said endless belt is broken on the basis of the output of said second detector when said air blower is operated while effecting the energization to said temperature raising portion, wherein said discriminating portion determines that said endless belt is broken when a detected temperature of said second detector is less than a predetermined temperature.

2. An image heating apparatus according to claim 1, further comprising a rotatable driving member configured to form a nip for heating the toner image on the sheet in cooperation with said endless belt and configured to rotationally drive said endless belt, wherein said discriminating portion discriminates whether or not said endless belt is broken on the basis of the output of said second detector when said temperature raising portion and said air blower are operated and said endless belt is driven by said rotatable driving member.

3. An image heating apparatus according to claim 1, wherein said temperature raising portion includes a heating portion configured to heat said endless belt.

4. An image heating apparatus according to claim 3, further comprising a rotatable driving member configured to form a nip for heating the toner image on the sheet in cooperation with said endless belt and configured to rotationally drive said endless belt, wherein said heating portion is provided opposed to said rotatable driving member so as to contact an inner surface of said endless belt.

5. An image heating apparatus according to claim 1, wherein said air blower includes two fans.

6. An image heating apparatus according to claim 1, wherein said air blower is configured of a single fan.

7. An image heating apparatus comprising:

an endless belt configured to heat a toner image on a sheet;

a temperature raising portion configured to raise a temperature of said endless belt;

a first detector configured to detect the temperature of said endless belt at a widthwise central portion of said endless belt;

a controller configured to control energization to said temperature raising portion depending on an output of said first detector;

a second detector configured to detect the temperature of said endless belt at one widthwise end portion of said endless belt;

a third detector configured to detect the temperature of said endless belt at another widthwise end portion of said endless belt;

an air blower configured to blow air depending on an output of said second detector to cool the one widthwise end portion of said endless belt; and a discriminating portion configured to discriminate whether or not said endless belt is broken on the basis of a temperature difference between the output of said second detector and an output of said third detector when said air blower is operated while effecting the energization to said temperature raising portion, wherein said discriminating portion discriminates that said endless belt is broken when the temperature difference is greater than a predetermined amount.

8. An image heating apparatus according to claim 7, further comprising a rotatable driving member configured to form a nip for heating the toner image on the sheet in cooperation with said endless belt and configured to rotationally drive said endless belt, wherein said discriminating portion discriminates whether or not said endless belt is broken on the basis of the temperature difference between said second detector and said third detector when said temperature raising portion and said air blower are operated and said endless belt is driven by said rotatable driving member.

9. An image heating apparatus according to claim 7, wherein said temperature raising portion includes a heating portion configured to heat said endless belt.

10. An image heating apparatus according to claim 7, wherein said air blower includes two fans.

11. An image heating apparatus according to claim 7, wherein said air blower is configured of a single fan.

* * * * *